US006475075B1

(12) United States Patent
Wuensch

(10) Patent No.: US 6,475,075 B1
(45) Date of Patent: Nov. 5, 2002

(54) HAND OPERATED BELT SANDER

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/914,740

(22) PCT Filed: Nov. 28, 2000

(86) PCT No.: PCT/DE00/04228

§ 371 (c)(1),
(2), (4) Date: Sep. 4, 2001

(87) PCT Pub. No.: WO01/56741

PCT Pub. Date: Aug. 9, 2001

(30) Foreign Application Priority Data

Feb. 3, 2000 (DE) ..... 100 04 698

(51) Int. Cl.[7] ..... B24B 23/06
(52) U.S. Cl. ..... 451/355; 451/296
(58) Field of Search ..... 451/355, 296, 451/59, 168, 490

(56) References Cited

U.S. PATENT DOCUMENTS 4,727,685 A 3/1988 Batt

FOREIGN PATENT DOCUMENTS

| | | | | |
|---|---|---|---|---|
| DE | 31 17 785 A | | 11/1982 | |
| GB | 352 754 A | | 7/1931 | |
| SU | 1079414 | * | 3/1984 | ..... 451/296 |

* cited by examiner

*Primary Examiner*—Robert A. Rose
(74) *Attorney, Agent, or Firm*—Michael J. Striker

(57) ABSTRACT

A hand band sander (10) with a housing (11) that contains a drive (15) for the sanding band (18) comprising a motor (16) with gear (17), which sanding band (18) can be driven in circulating fashion by way of a drive pulley (19) that can be driven in rotary fashion, and preferably by way of a return pulley (20), is smaller, easier to handle, and more reasonably priced due to the fact that the drive pulley (19) is arranged and supported coaxially to the drive (15) and is driven directly by the output of the gear (17).

7 Claims, 3 Drawing Sheets

HAND OPERATED BELT SANDER

RELATED ART

The invention concerns a hand band sander according to the preamble of Claim 1.

Hand band sanders according to the general class in the form of hand band sanding machines are known that are designed as hand-operated devices of considerable size and considerable weight and therefore have two handles located some distance apart and that must be held by both handles to be used. To realize desired optimal band speeds of the sanding band, universal motors are run at high speeds, whereby the speed is then geared down by way of a multistage gear, e.g., in the form of a spur-toothed wheel or angular gear in combination with a toothed belt gear. The drive of the motor is therefore usually controlled by way of a pinion on a toothed wheel supported at a distance from it, both of which are connected in gear-like fashion by way of a toothed belt. The toothed wheel itself drives a spur gear, on the driven shaft of which the drive pulley is situated, which is therefore located at a distance from the motor. Such a drive is heavy, expensive, and takes up a great deal of space. It requires costly housing and support designs.

ADVANTAGES OF THE INVENTION

Compared to known hand band sanders, the hand band sander according to the invention having the features of Claim 1 is smaller, easier to handle, and more reasonably priced while maintaining the basic advantages of the band sander, which are high abrasion and achievement of a longitudinal grinding profile during operation. Due to the fact that the drive pulley and, therefore, the drive of the sanding band are arranged coaxially to the drive, in particular to the motor shaft, a compact, space-saving design with weight reduction is possible, which makes a low-profile design of the hand band sander possible and, as a result, it makes single-handed operation possible as well. The drive design therefore renders profiled shafts and support unnecessary.

Advantageous further designs and improvements of the hand band sander indicated in Claim 1 are possible as a result of the measures listed in the further claims.

DRAWING

The invention is described in greater detail below using a design example presented in the drawing.

Figure 1:
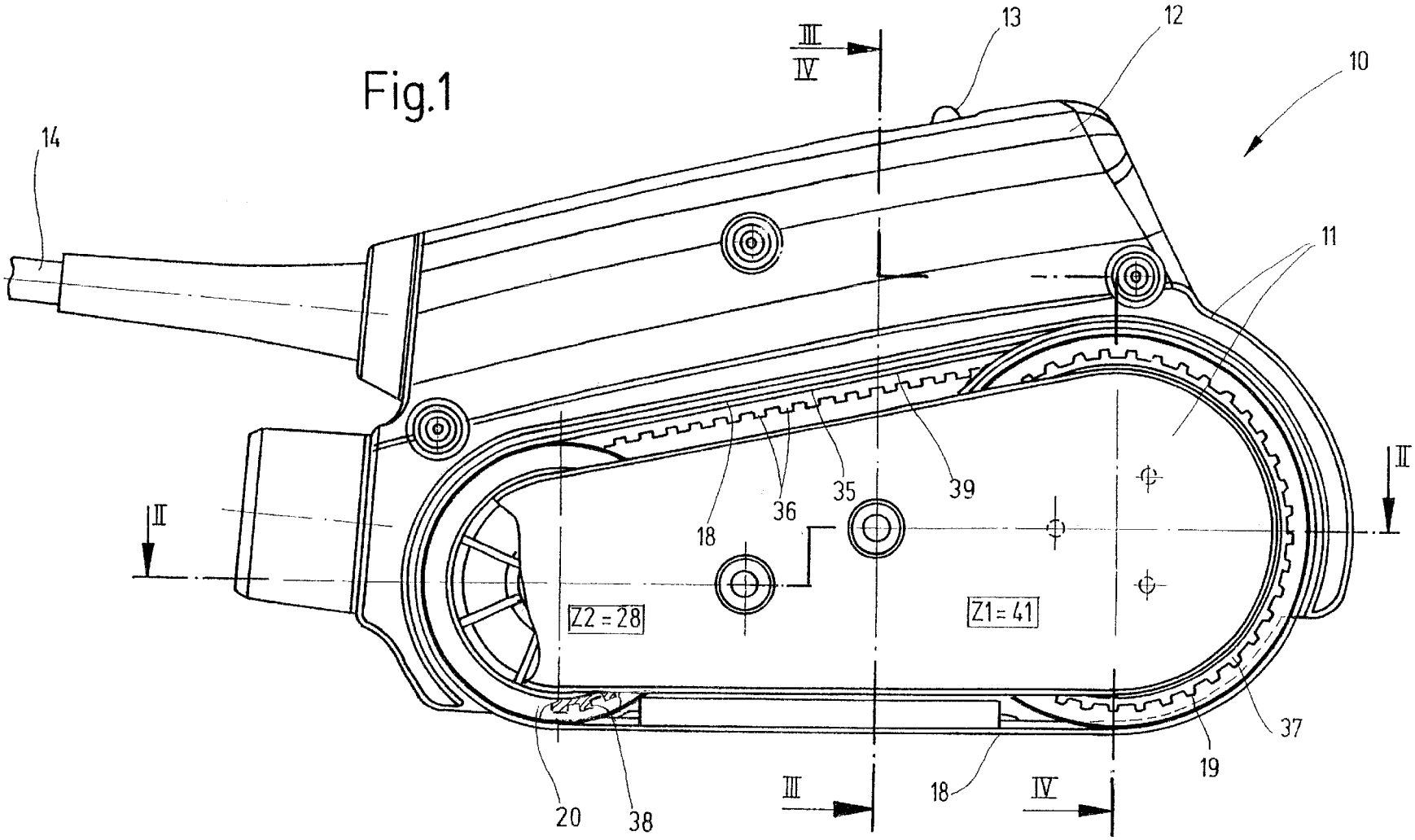
FIG. 1 shows a diagrammatic side view of a hand band sander.
Figure 3:
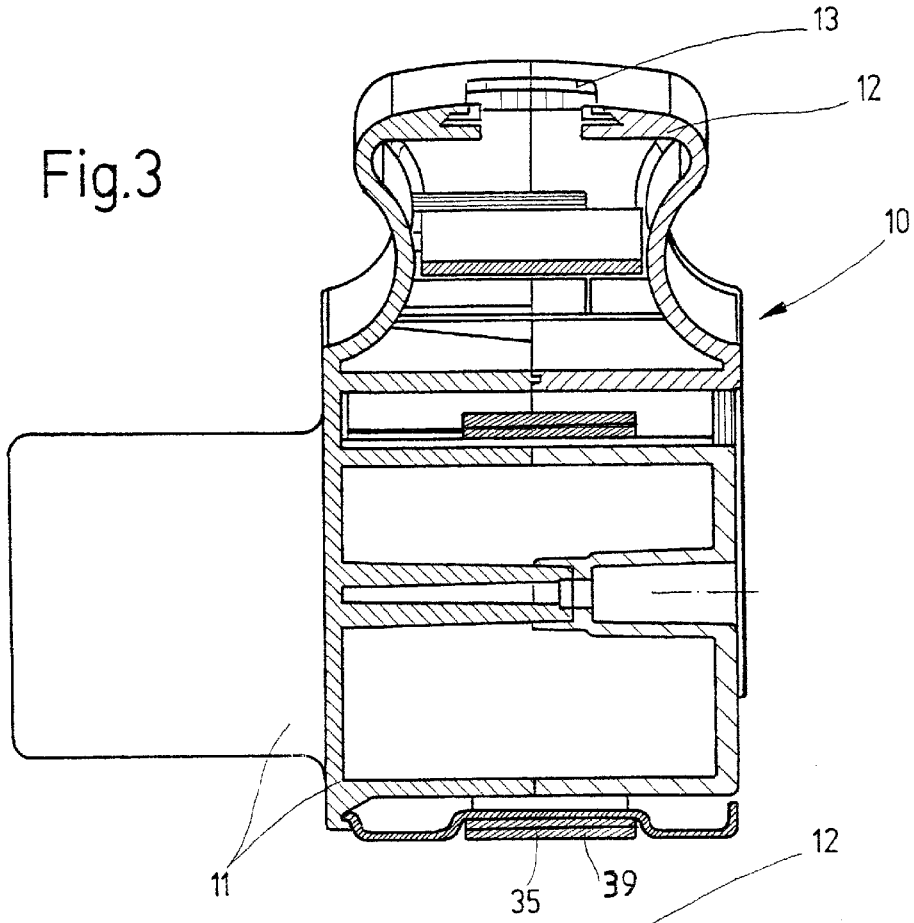
Figure 4:
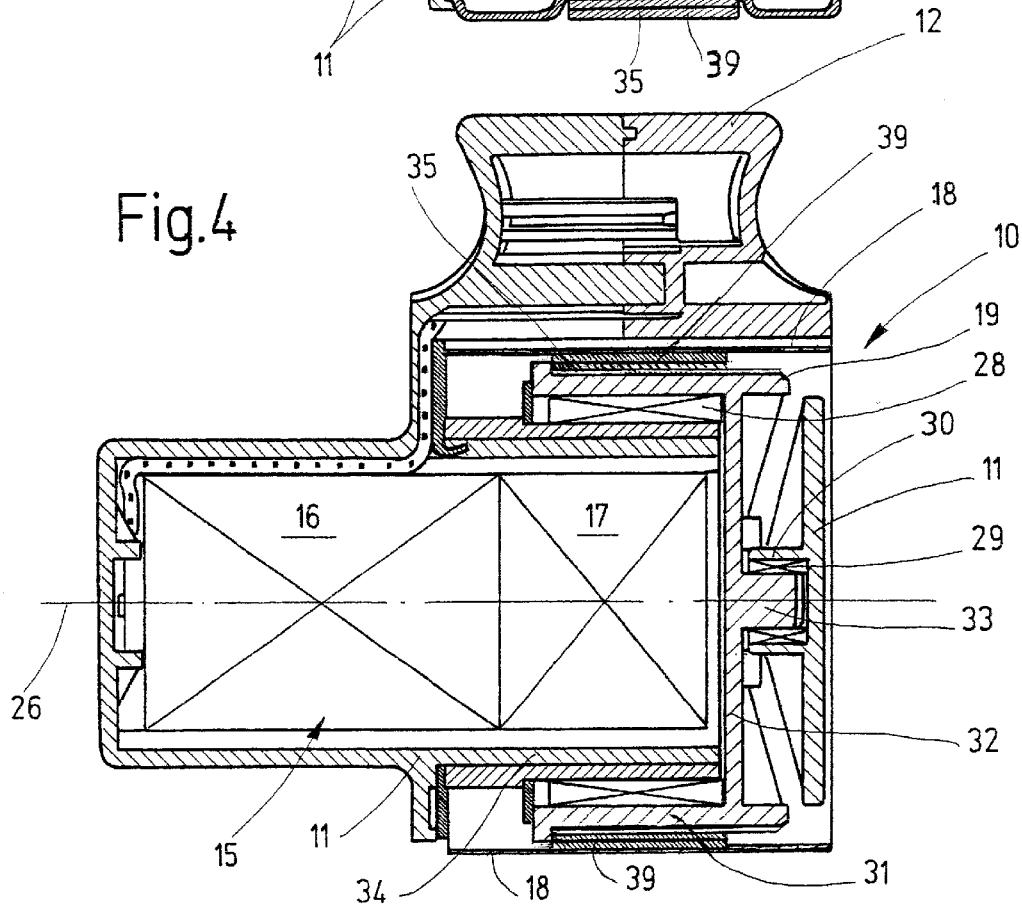

FIG. 3 and FIG. 4 each show a diagrammatic view along the lines III—III and IV—IV in FIG. 1, respectively.

DESIGN EXAMPLE

A hand sand bander 10 is shown in the diagrams as an example of a hand band sanding machine comprising a housing 11 with handle 12 on the top side designed approximately in the shape of a strap. On the top side in the right-hand area in FIG. 1, the handle 12 contains a switch designed as a sliding switch 13, by way of which the electrical energy supplied by means of an electric cord 14 can be controlled, which serves to supply a drive—indicated in general with number 15—inside the housing 11. The drive

15 comprises an, in particular, electric motor 16 with gear 17 and serves to drive a sanding band 18—shown only diagrammatically—which can be driven in circulating fashion by way of a drive pulley 19 that can be driven in rotary fashion, and a return pulley 20 supported at a distance from it in rotatable fashion in the housing 11 and which can be driven by way of rotary operation of the drive pulley 19. The housing 11 represents a formation that is basically multipart and extends in the longitudinal direction, the individual parts of which are put together in removeable fashion, e.g., using screws, or they are clipped on or connected with each other in another fashion. The outer diameter of the drive pulley 19 is greater than that of the return pulley, which is held on a shaft 21, which is supported at both ends in rotatable fashion in assigned bearing receptacles 24 and 25 of the housing 11 by means of bearings 22, 23, e.g., needle bearings. The drive 15, comprising motor 16 and gear 17, is indicated only diagrammatically, whereby it is obvious that the motor 16 with its longitudinal center axis 26 is oriented transversely to the longitudinal course of the sanding band 18, in particular of the upper and lower sides of the belt. The gear 17 of the drive 15—which is also shown only diagrammatically—connects to the end of the motor 16 on the right in FIGS. 2 and 4 in basically gapless fashion and runs in-line to the motor 16, whereby a motor pinion, which is not shown further, forms the output of the motor 16 that meshes in the gear 17 to drive it. The drive 17 is advantageously designed as a two-stage planet gear and has an output on the right axial end in FIGS. 2 and 4, e.g., in the form of a driven journal 27—indicated only diagrammatically—that rotates around the longitudinal center axis 26.

Figure 2:
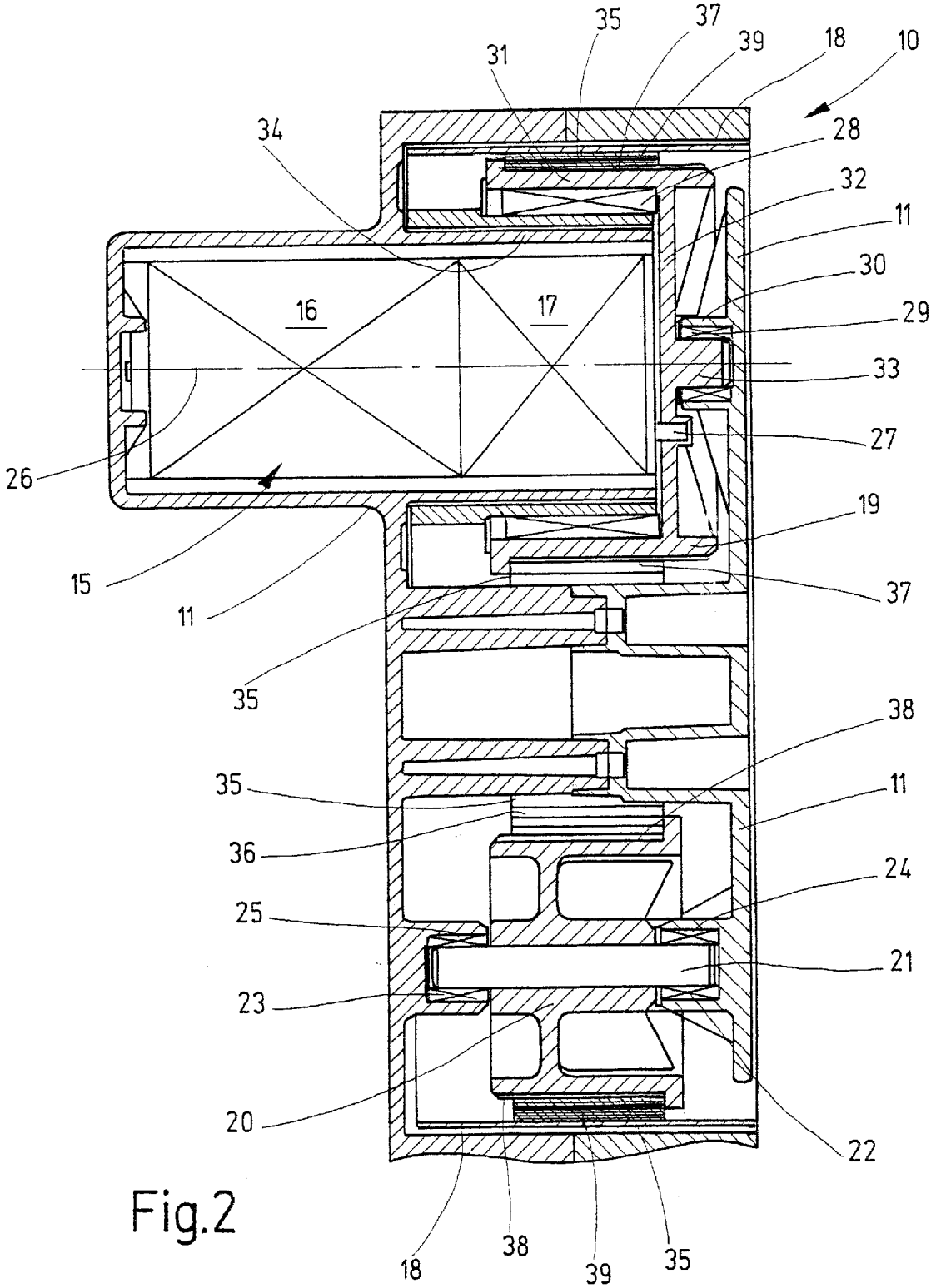
FIG. 2 shows a diagrammatic view along the line II—II in FIG. 1.

The drive pulley 19 for the sanding band 18 is arranged coaxially to the drive 15 and, therefore, to the longitudinal center axis 26, and it is supported in rotatable fashion in the housing 11 by means of bearings 28 and 29. The bearing 29 is accommodated in an assigned bearing receptacle 30 of the housing 11. The drive pulley 19 is driven directly by the gear output, e.g, by way of the driven journal 27. The drive pulley 19 is arranged concentrically and, in relation to the longitudinal center axis 26, coaxially to the drive 15 and, thereby, in such a fashion that it extends axially over approximately the entire axial length of the gear 17. The drive pulley 19 is designed to be approximately in the shape of a bell or a cup and, with this design, it has a basically cylindrical cup wall 31 and, therefore, a single-part base 32 that carries a coaxial journal 33, with which the drive pulley 19 is supported in the housing 11 in rotatable fashion by means of the bearing 29, e.g., in the form of a ball or needle bearing. In this design, the drive pulley 19 basically represents a single-part component. It is supported directly on the drive 15 or, as shown in FIGS. 2 and 4, on a sleeve 34 of the housing 11 surrounding the drive 15 in rotatable fashion by means of the bearing 28, e.g., in the form of a needle bearing, located on the inside of the cup wall 31 surrounding the drive 15, e.g, the gear of this. When supported directly on the drive 15 by means of the bearing 28, e.g., on the circumference of the gear 17, the sleeve 34 is eliminated completely or at least partially. The sanding band 18 wraps around the drive pulley 19 on the outer side of the cup wall 31. The drive pulley 19, which is coaxial to the drive 15, can be advantageously slipped onto the right axial end of the drive 15 shown in FIGS. 2 and 4, in particular of the gear 17. It can thereby be connected with the gear output, e.g., the driven journal 27, which represents the output of the second stage of the planet gear.

The sanding band 18 is carried by a sanding toothed belt 35, the toothed side having its teeth 36 of which faces the drive pulley 19 and, similarly, the return pulley 20 as well. Both the drive pulley 19 and, similarly, the return pulley 20 have counter-toothing with teeth 37 and 38, respectively, on the outer side, with which the sanding toothed belt 35 meshes in positive fashion. A connection is provided between the sanding band 18 and the sanding toothed belt 35 by means of a surface bonding agent indicated in general with 39, in particular a velcro seal. In the design of the surface bonding agent 39 as a velcro seal, the layer having the velcro hooks is provided on the outer side of the sanding toothed belt 35 facing away from the teeth 36, while the velour layer is applied to the back side of the sanding band 18. The surface bonding agent 39 makes a connection between the replaceable sanding band 18 and the sanding toothed belt 35 that is removeable and firm and force-transmitting during the sanding procedure. As a result of this connection using the surface bonding agent 39, setting and adjustment devices for adjusting the band tension can be eliminated. Due to the positive connection of the sanding band 18 with the driven sanding toothed belt 35, there is no slippage which would otherwise produce unnecessary heat and, under a stronger load, lead to damage to the drive pulley 19 and the sanding band 18.

Since the drive pulley 19 is situated coaxially to the drive 15 and is situated in such a way that it covers the drive 15 with its cup wall 15, at least on one part of the axial length, e.g., the axial length of the gear 17, and surrounds the drive 15 in the circumferential direction, a particularly low-profile design of the hand band sander 10 is achieved that, as a result, is small, easy to handle, and reasonably priced while maintaining the basic advantages of the band sander of high abrasive performance and a longitudinal grinding profile. The drive 15, in particular the motor 16 and the gear 17, can be accommodated in the housing 11 in space-saving fashion using this design. Due to the in-line arrangement of the gear 17 coaxially to the motor 16, profiled shafts and support therefore become unnecessary. The driving of the sanding band 18 takes place in the circumferential region of the drive 16 and in extension of the motor shaft of the motor 16. This leads to an extremely compact design having few components and low weight. The compact, low-profile design results in a position of the handle 12 that is close to the working surface of the sanding band 18. This results in a handle position with a minimal height separation from the working surface. The hand band sander 10 can be held and guided with one hand, making true single-handed operation possible, which is also why a potential additional handle for holding and guiding is unnecessary.

What is claimed is:

1. Hand band sander (10) with a housing (11) that contains a drive (15) for a sanding band (18) comprising a motor (16) with gear (17), which sanding band (18) is driven in circulating fashion by way of a drive pulley (19) that is driven in rotary fashion, and by way of a return pulley (20) as well, characterized in that the drive pulley (19) is arranged and supported coaxially to the drive (15) and is driven directly by the gear output, wherein the drive pulley (19) is designed approximately in the shape of a cup, is supported directly on the drive (15) or on a sleeve (34) of a housing (11) surrounding the drive (15) by means of a bearing (28) on an inside of a cup wall (31) surrounding the drive (15), wherein the drive pulley (19) has the sanding band (18) wrapped around it on an outer side of the cup wall (31).

2. Hand band sander according to claim 1, characterized in that the drive pulley (19) is arranged concentrically to the drive (15).

3. Hand band sander (10) with a housing (11) that contains a drive (15) for a sanding band (18) comprising a motor (16) with gear (17), which sanding band (18) is driven in circulating fashion by way of a drive pulley (19) that is driven in rotary fashion, and by way of a return pulley (20) as well, characterized in that the drive pulley (19) is arranged and supported coaxially to the drive (15) and is driven directly by the gear output, wherein the drive pulley (19) is designed approximately in the shape of a cup, is supported directly on the drive (15) or on a sleeve (34) of a housing (11) surrounding the drive (15) by means of a bearing (28) on an inside of a cup wall (31) surrounding the drive (15), wherein the drive pulley (19) has the sanding band (18) wrapped around it on an outer side of the cup wall (31), wherein the drive pulley (19) has a journal (33) coaxial to the cup wall (31) in the base (32) with which the drive pulley (19) is supported by means of a bearing (29) in the housing (11).

4. Hand band sander (10) with a housing (11) that contains a drive (15) for a sanding band (18) comprising a motor (16) with gear (17), which sanding band (18) is driven in circulating fashion by way of a drive pulley (19) that is driven in rotary fashion, and by way of a return pulley (20) as well, characterized in that the drive pulley (19) is arranged and supported coaxially to the drive (15) and is driven directly by the gear output, wherein the drive pulley (19) is designed approximately in the shape of a cup, is supported directly on the drive (15) or on a sleeve (34) of a housing (11) surrounding the drive (15) by means of a bearing (28) on an inside of a cup wall (31) surrounding the drive (15), wherein the drive pulley (19) has the sanding band (18) wrapped around it on an outer side of the cup wall (31), wherein the sanding band (18) is carried by a sanding toothed belt (35), the toothed side of which faces the drive pulley (19), and wherein the drive pulley (19) has a counter-toothing on the outer side with which the sanding toothed belt (35) meshes.

5. Hand band sander according to claim 1, characterized in that the drive (15) comprises a motor (16) oriented transversely to the longitudinal course of the sanding band (18) having a gear (17) that runs in-line with it and is driven by a motor pinion, wherein said motor pinion is two-stage planet gears, on the axial end of which the drive pulley (19) can be slipped, and can thereby be connected with the gear output of the second stage of the planet gear.

6. Hand band sander according to claim 5, characterized in that the drive pulley (19) extends axially with the cup wall (31) over a part of the drive (15), said drive pulley (19) extending approximately over an entire axial length of the gear (17).

7. Hand band sander (10) with a housing (11) that contains a drive (15) for a sanding band (18) comprising a motor (16) with gear (17), which sanding band (18) is driven in circulating fashion by way of a drive pulley (19) that is driven in rotary fashion, and by way of a return pulley (20) as well, characterized in that the drive pulley (19) is arranged and supported coaxially to the drive (15) and is driven directly by the gear output, wherein the drive pulley (19) is designed approximately in the shape of a cup, is supported directly on the drive (15) or on a sleeve (34) of a housing (11) surrounding the drive (15) by means of a bearing (28) on an inside of a cup wall (31) surrounding the drive (15), wherein the drive pulley (19) has the sanding band (18) wrapped around it. on an outer side of the cup wall (31), wherein the sanding band (18) is carried by a sanding toothed belt (35), the toothed side of which faces the drive pulley (19), and wherein the drive pulley (19) has a counter-toothing on the outer side with which the sanding toothed belt (35) meshes, wherein a connection is provided between the sanding band (18) and the sanding toothed belt (35) by means of a surface bonding agent (39).

US 6,475,075 B1
5 6

* * * * *